US006170708B1

(12) United States Patent
Chen et al.

(10) Patent No.: US 6,170,708 B1
(45) Date of Patent: Jan. 9, 2001

(54) DUAL-DISPENSER BOTTLE HAVING MIDDLE ORNAMENTAL WINDOW

(76) Inventors: Tsan-Yao Chen, 6F, No. 76, Sec. 3, Hsin Shin N. Road, Taipei; En-Cheng Lin, No. 7, Alley 8, Lane 243, Jen Ho St., Pa Te City, Tao Yuan Hsien, both of (TW)

( * ) Notice: Under 35 U.S.C. 154(b), the term of this patent shall be extended for 0 days.

(21) Appl. No.: 09/472,516

(22) Filed: Dec. 27, 1999

(51) Int. Cl.[7] ..... B67D 5/52
(52) U.S. Cl. ..... 222/135; 220/501; 215/6
(58) Field of Search ..... 220/501, 507; 215/6; 222/135, 142.4

(56) References Cited

U.S. PATENT DOCUMENTS 1,463,543 * 7/1923 Baeder ..... 222/142.4
1,511,817 * 10/1924 Montague ..... 222/142.4
4,029,236 * 6/1977 Carson, Jr. et al. ..... 222/135
5,312,014 * 5/1994 Hamlin ..... 220/501
5,740,947 * 4/1998 Flaig et al. ..... 222/135
6,062,380 * 5/2000 Dorney ..... 215/6

* cited by examiner

*Primary Examiner*—Philippe Derakshani
*Assistant Examiner*—Thach H Bui
(74) *Attorney, Agent, or Firm*—Dougherty & Troxell

(57) ABSTRACT

A dual-dispenser bottle having middle ornamental window is provided. The bottle is vertically divided into top, middle and bottom sections and both the top and the bottom sections are further horizontally divided into two chambers. The two top chambers are provided with a mouth each for two dispenser heads to connect thereonto. The middle section defines an inner space through which two spaced pipes separately in alignment with the mouths vertically extend. The two bottom chambers are separately communicable with the two top chambers via the two spaced pipes. Whereby the top and the bottom chambers at two sides of the bottle form two independent vertical spaces for the bottle to contain two different fluids at the same time. The inner space of the middle section may have, for example, a dual-liquid ornament provided therein to make the bottle an ornamental article very practical for use.

3 Claims, 6 Drawing Sheets

DUAL-DISPENSER BOTTLE HAVING MIDDLE ORNAMENTAL WINDOW

BACKGROUND OF THE INVENTION

The present invention relates to a dual-dispenser bottle having middle ornamental window, and more particularly to a bottle that includes top and bottom sections that are separately divided into two laterally adjacent chambers and a middle section having two vertical pipes extended therethrough to communicate the top and the bottom chambers at the same side of the bottle, so that the top and the bottom chambers at two sides of the bottle form two vertical spaces for containing two different fluids at the same time and the middle section may have, for example, a dual-liquid ornament provided therein to make the bottle a good ornament.

The dual-liquid ornament is a conventional and popular ornament. Typically, the dual-liquid ornament includes a closed container in which clear oil and colored water are contained, and one or more preferably three-dimensional floating items are disposed in the container to float between the oil and the water. The dual-liquid ornament has been widely associated with various kinds of articles, such as paperweight and penholder in the early stage and lamp stand, glass bottom, soap case and milky lotion bottle in recent years. For most milky lotion bottles that have dual-liquid ornaments associated therewith, they usually have a single-space clear body provided with one mouth and one lotion dispenser while the dual-liquid ornament is always an additional closed area located at top, bottom or one side of the bottle body to form an ornamental window on the bottle. The following are some of the disadvantages of the conventional milky lotion bottles with dual-liquid ornaments:

1. They are almost the same as any other milky lotion bottles in appearance, except that an additional space for showing the dual-liquid ornament is provided in the bottles. Since the dual-liquid ornament has become a very popular ornament, a general milky lotion bottle with such ornament would no longer strongly attract consumers.
2. They provide only one single space for containing only one type of milky lotion while there are usually many different kinds of lotions needed in a toilet room. Therefore, a lot of bottles for different lotions would occupy a large space in the toilet room and make the room disorderly.

SUMMARY OF THE INVENTION

It is therefore a primary object of the present invention to provide a bottle having two dispensers and a middle ornamental window. The bottle according to the present invention includes top, middle and bottom sections. The top and the bottom sections are separately divided into two laterally adjacent chambers and the middle section has two vertical pipes extended therethrough to separately communicate the top and the bottom chambers at the same side of the bottle, so that the top and the bottom chambers at two sides of the bottle form two vertical spaces for containing two different fluids at the same time. And, the middle section may have, for example, a dual-liquid ornament contained therein to provide the bottle with an ornamental window.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
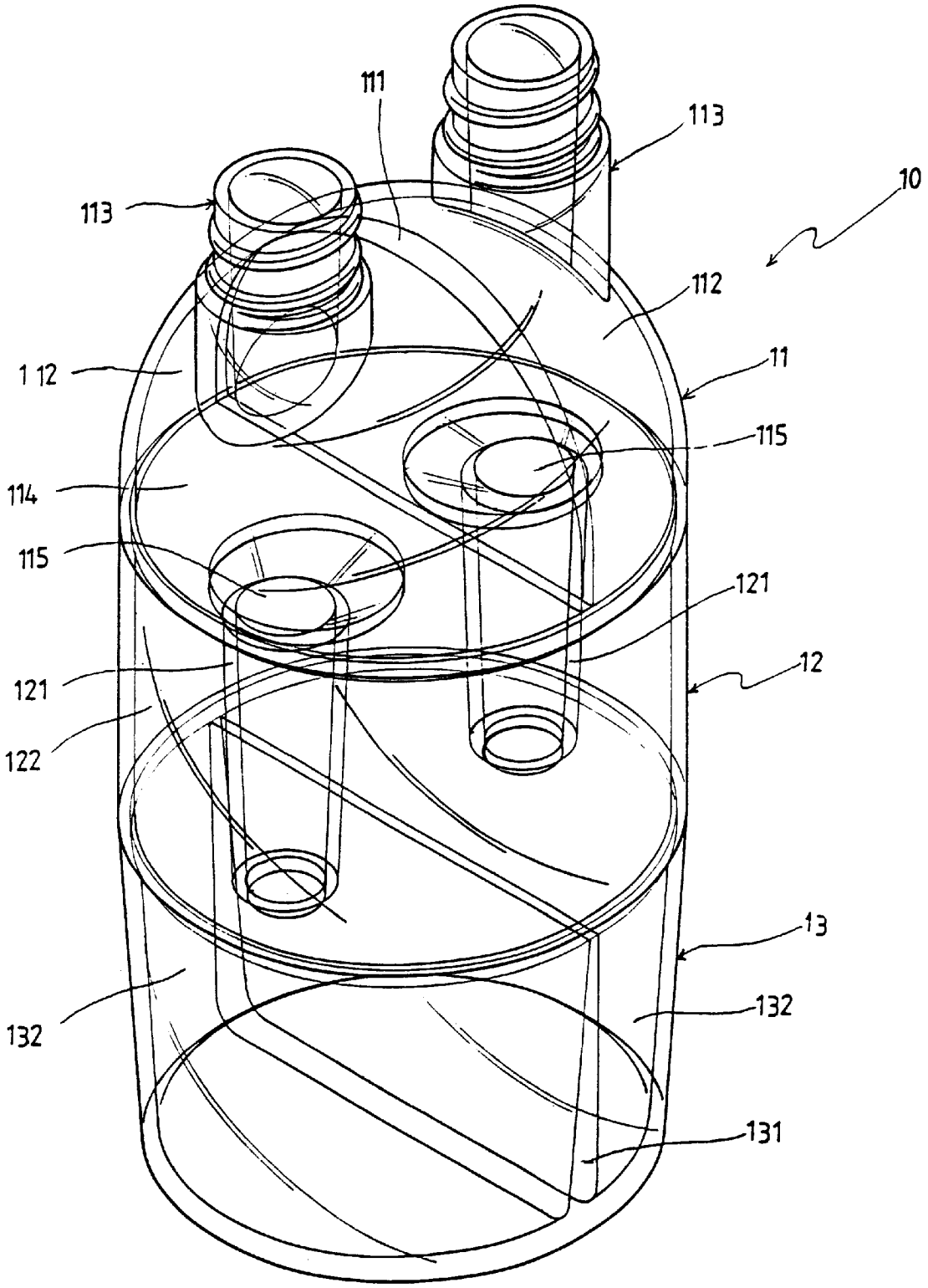
FIG. 1 is a perspective of a dual-dispenser bottle having middle ornamental window according to an embodiment of the present invention.
Figure 3:
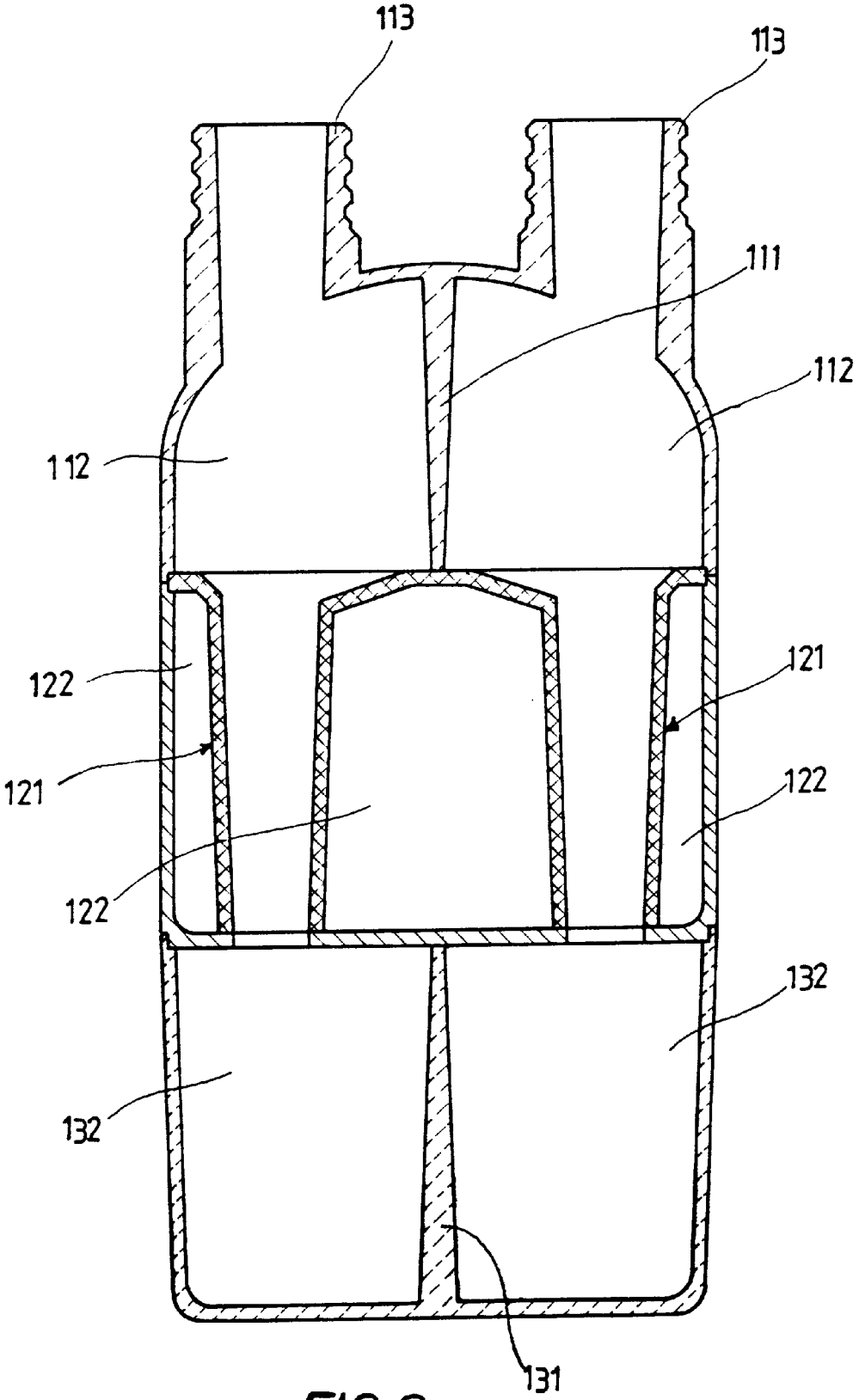
FIG. 3 is a vertical sectional view of the bottle of FIG. 1 to show the structure thereof.

Please refer to FIGS. 1 and 3 that are perspective and vertical sectional views, respectively, of a dual-dispenser bottle 10 having middle ornamental window according to an embodiment of the present invention. The bottle 10 is divided in vertical direction into three sections, namely, a top section 11, a middle section 12, and a bottom section 13. Each of these sections defines an inner space.

The top section 11 includes a vertical partition 111 that further divides the top section 11 into two horizontally adjacent chambers 112. Each of these top chambers 112 is provided at an upper end with an upward projected and externally threaded mouth 113 for a dispenser head 20 to screw thereonto. The chambers 112 are also provided at their bottom surface 114 with a through hole 115 each. A pipe 121 is integrally connected to the through hole 115 to vertically extend downward from the bottom surface 114. The mouth 113, the through hole 115, and the pipe 121 are preferably located in the same vertical line to facilitate easy assembling of the dispenser head 20 and an inner dispenser tube 21 thereof into the bottle 10.

The two pipes 121 separately extend through the inner space of the middle section 12 in such a manner that the rest part of the inner space of the middle section 12 forms a single middle chamber 122.

The bottom section 13 also includes a vertical partition 131 that further divides the bottom section 13 into two horizontally adjacent chambers 132. The two pipes 121 end at a bottom surface of the middle section 12 to separately communicate with the two bottom chambers 132.

Figure 2:
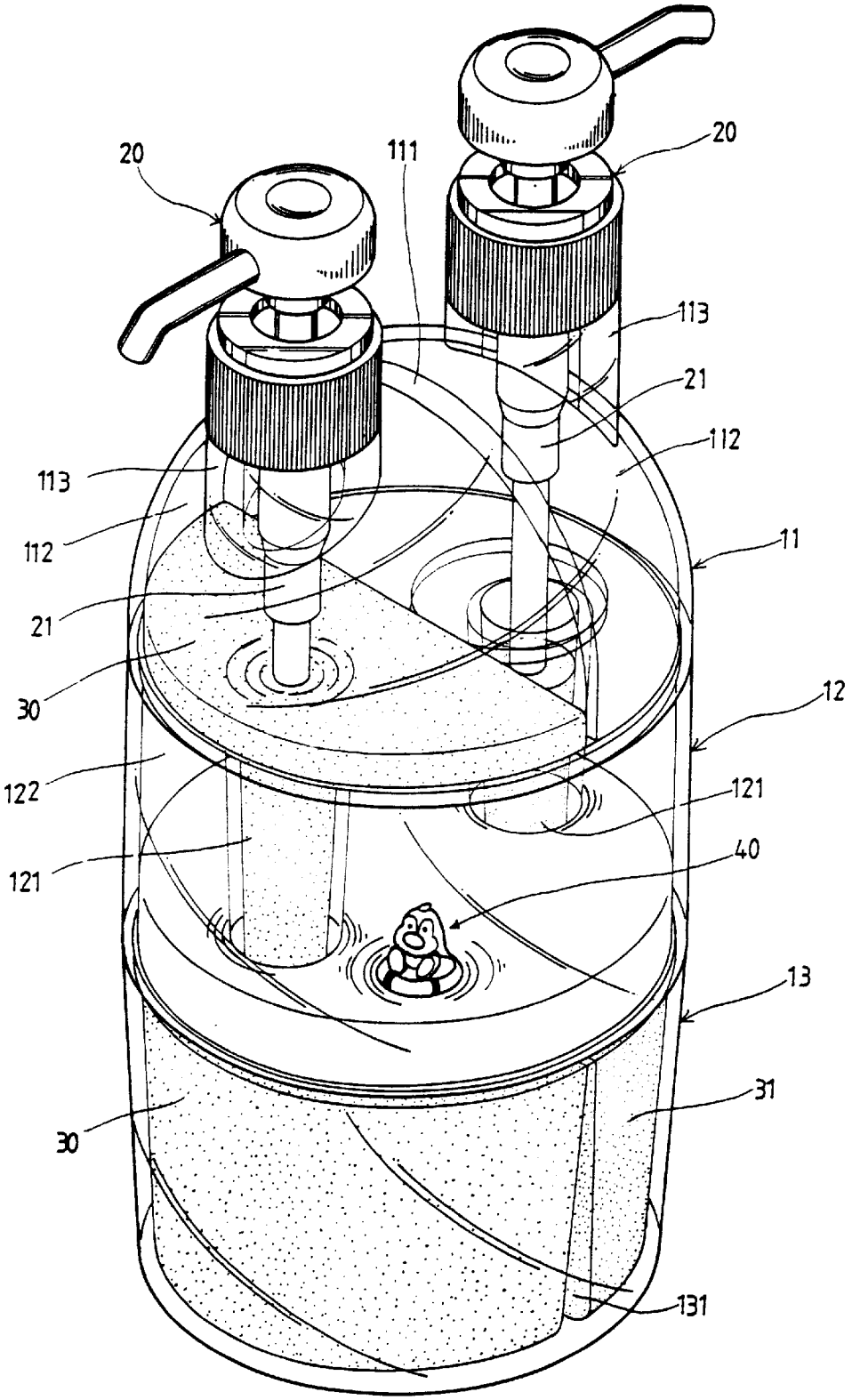
FIG. 2 is a perspective of the bottle of FIG. 1 in use.

With the above arrangements, two laterally separated spaces are formed in the bottle 10. That is, each of these laterally separated spaces includes one top chamber 112 and one bottom chamber 132 at the same side of the bottle 10, one mouth 113 that communicates a corresponding lateral space with external space, and one pipe 121 that communicates the top chamber 112 with the bottom chamber 132. As is shown in FIG. 2, the two laterally separated spaces may be conveniently used to contain two different fluids, for example, two different milky lotions 30 and 31, at the same time. Meanwhile, the middle chamber 122 in the middle section 12 may be used to contain some decorative things, such as a dual-liquid ornament 40 and form an ornamental window on the middle section 12 of the bottle 10.

Figure 4:
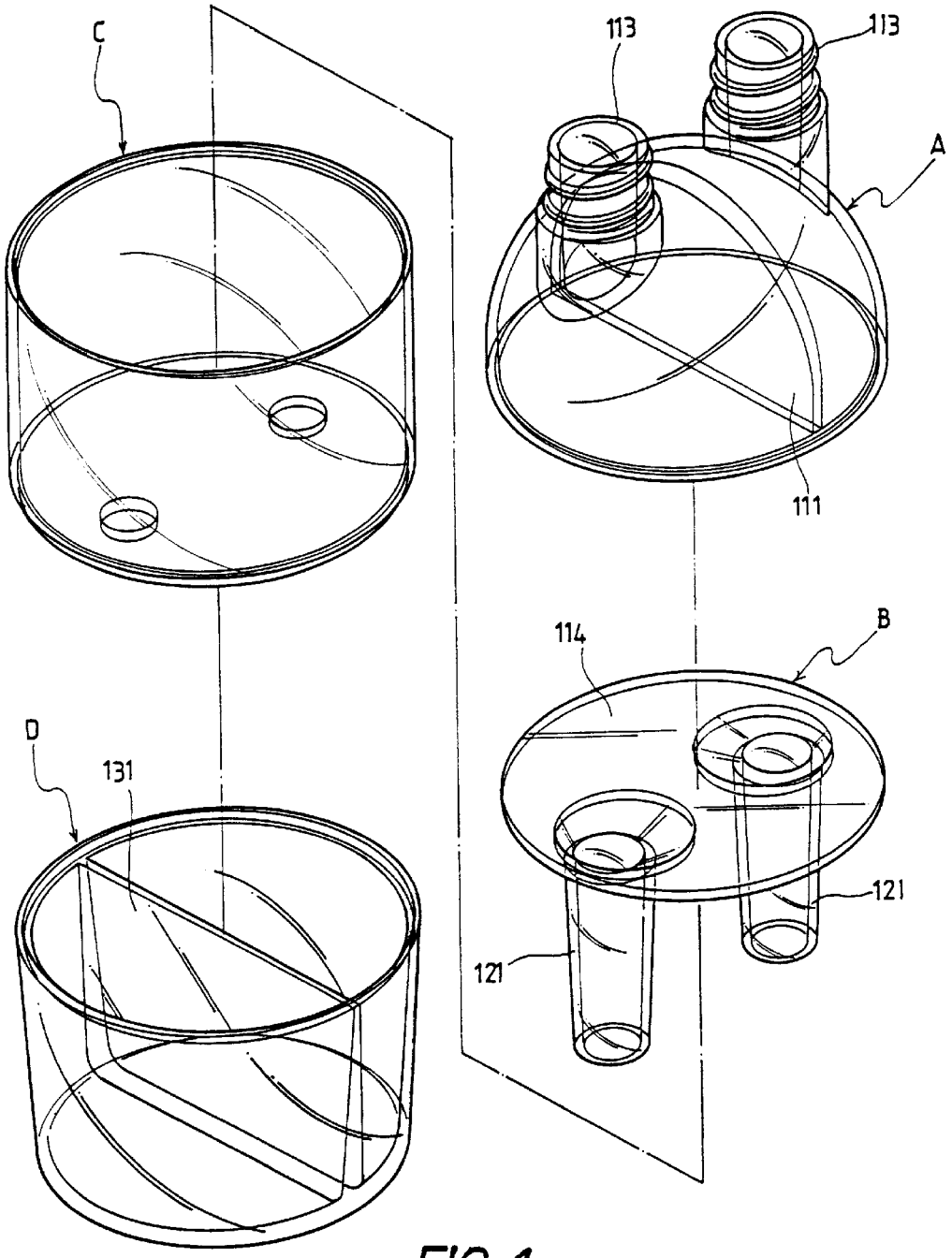
FIG. 4 is an exploded perspective of the bottle of FIG. 1.

FIG. 4 is an exploded perspective of the bottle 10 to show major components A, B, C, and D thereof. All these components A, B, C and D are in the form of hollow shells and may be individually integrally formed from transparent plastic material through injection molding. By means of supersonic welding, these components A, B, C and D are assembled to form a complete unit. Since the whole assembling of these components, including a step of putting the dual-liquid ornament 40 into the middle section 12, that is, the component C, can be accomplished by manufacturers with currently available skills, it is not described in details herein. Finally, two different fluids, such as milky lotions 30 and 31, may be filled into the bottle 10 via the two mouths 113.

Figure 5:
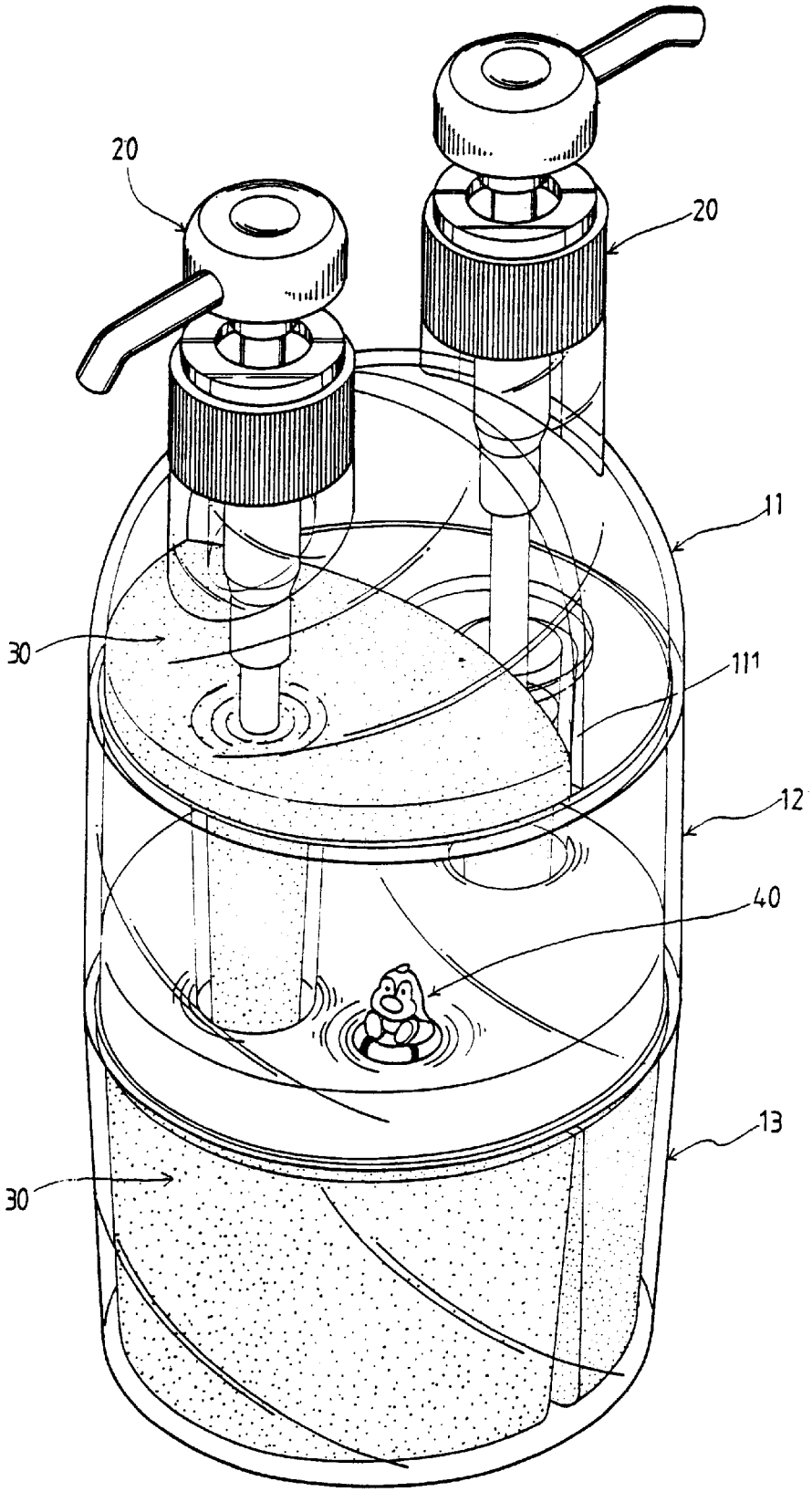
FIG. 5 is a perspective of a dual-dispenser bottle having middle ornamental window according to another embodiment of the present invention.

It is to be noted that the bottle 10 is not necessarily formed through injection molding and is not limited to any specific design. For instance, the top, the middle and the bottom sections 11, 12 and 13 may have different heights, the partitions 111 and 121 maybe straight or curved or any other differently shaped members, and the pipes 121 may have different diameters or locations. That is, the whole bottle 10 may be designed completely depending on market demands and produced by making suitable molds. FIG. 5 illustrates another embodiment of the present invention in which the partition 111 is a curved member instead of a straight member as that shown in FIG. 1.

Figure 6:
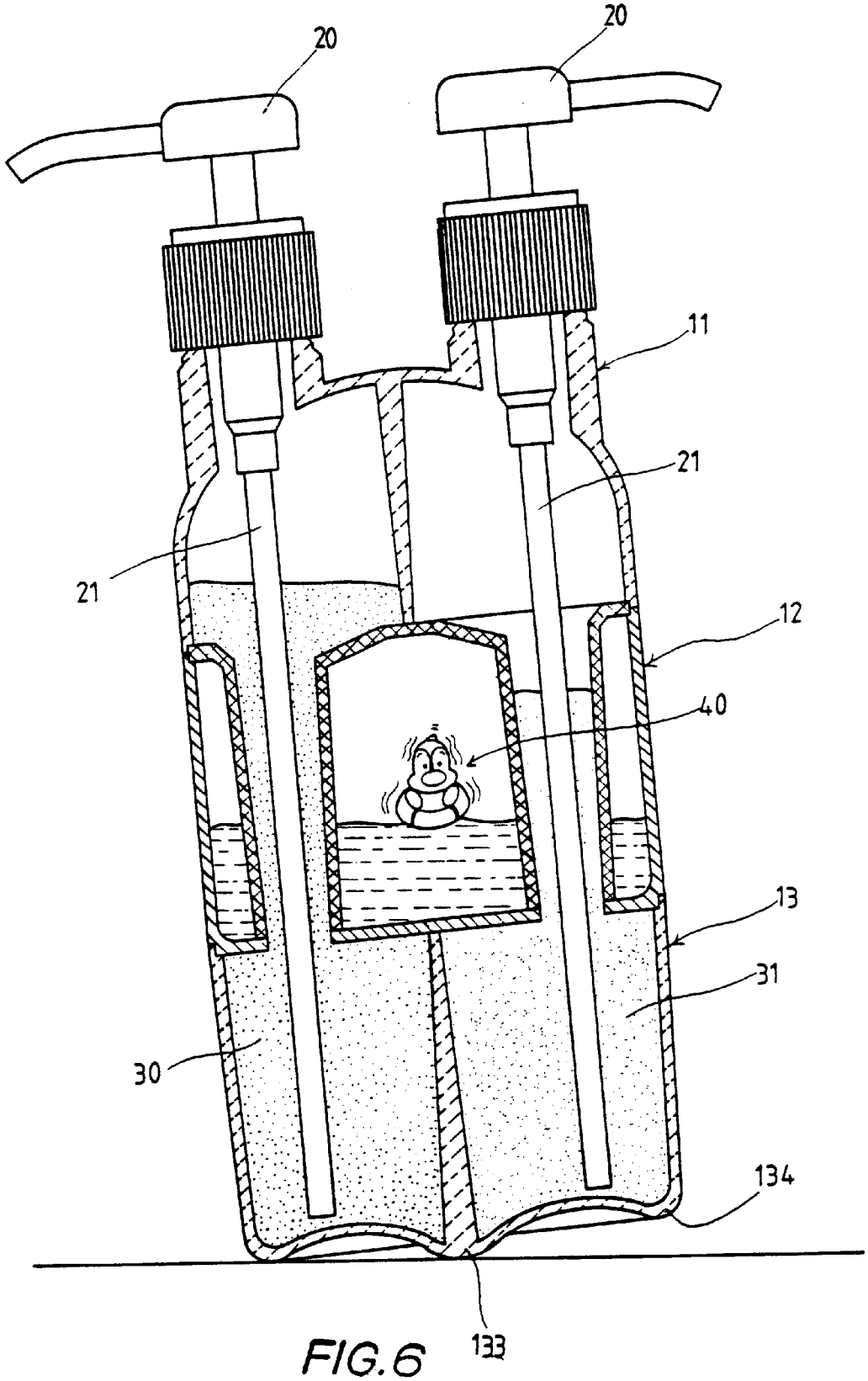
FIG. 6 is a perspective of a dual-dispenser bottle having middle ornamental window according to a further embodiment of the present invention.

FIG. 6 is a sectional view of a further embodiment of the bottle 10. In this embodiment, the bottom section 13 includes an upward curved bottom surface with a rounded center 133 thereof slightly downward projected beyond an outer lower periphery 134 of the bottom surface. That is, the bottom center 133 of the bottle 10 of FIG. 6 forms a central pivoting point of the bottle 10. When a minor force is applied on the bottle 10, such as when a user depresses the dispenser head 20 in order to get some milky lotion 30 from the bottle 10, or when the user unintentionally touches the bottle 10, the bottle 10 tends to pivotally turn or swing for a short period of time, causing the dual-liquid ornament 40 in the chamber 122 of the middle section 12 to move and show dynamic and changeful views.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A dual-dispenser bottle having middle ornamental window comprising a top section, a middle section, and a bottom section;

said top section including a vertical partition that further divides said top section into two horizontally adjacent top chambers, each of which being provided at an upper end with an upward projected and externally threaded mouth for a dispenser head to screw thereonto, said top chambers each being provided at a bottom surface with a through hole and a pipe integrally connected to said through hole to vertically extend downward from the bottom surface;

said middle section defining an inner space through which said two vertically extended pipes extend such that the rest part of said inner space of said middle section forms a single middle chamber; and said bottom section also including a vertical partition that further divides said bottom section into two horizontally adjacent bottom chambers, each of which being communicable with a lower end of one of said vertically extended pipes;

whereby two laterally separated spaces are formed in said bottle to each include one said top chamber and one said bottom chamber at the same side of said bottle, one said mouth that communicates a corresponding lateral space with external space, and one said vertically extended pipe that communicates said top chamber with said bottom chamber, so that two different fluids, such as milky lotions, could be conveniently contained in said bottle at the same time; and said middle chamber in said middle section may be used to contain some decorative things, such as a dual-liquid ornament, and form an ornamental window on said middle section of said bottle.

2. A dual-dispenser bottle having middle ornamental window as claimed in claim 1, wherein said mouth, said through hole on said bottom surface of said top section, and said vertically extended pipe that are at the same side of said bottle are preferably in the same vertical line to facilitate easy assembling of said dispenser head and an inner tube thereof to said bottle.

3. A dual-dispenser bottle having middle ornamental window as claimed in claim 1, wherein said bottle is not necessarily formed through injection molding and is not limited to any specific design, including individual heights of said top, said middle and said bottom sections, configurations of said partitions in said top and said bottom sections, and diameters and/or locations of said two vertical pipes.

* * * * *